US008887867B2

(12) United States Patent
Blazin et al.

(10) Patent No.: US 8,887,867 B2
(45) Date of Patent: Nov. 18, 2014

(54) LADDER STABILIZATION DEVICE

(76) Inventors: Glenda Blazin, Melbourne, FL (US); Thomas Corley, Louisville, KY (US)

( * ) Notice: Subject to any disclaimer, the term of this patent is extended or adjusted under 35 U.S.C. 154(b) by 195 days.

(21) Appl. No.: 13/209,478

(22) Filed: Aug. 15, 2011

(65) Prior Publication Data

US 2011/0290587 A1 Dec. 1, 2011

Related U.S. Application Data

(63) Continuation-in-part of application No. 12/260,636, filed on Nov. 18, 2009, now Pat. No. 8,464,834.

(51) Int. Cl.
*E06C 7/00* (2006.01)
*E06C 7/18* (2006.01)

(52) U.S. Cl.
CPC ..... *E06C 7/188* (2013.01)
USPC ..... 182/107; 182/109; 182/129; 248/210; 248/211

(58) Field of Classification Search
USPC ..... 182/107, 109, 111, 129; 280/293; 135/118; 248/211
See application file for complete search history.

(56) References Cited

U.S. PATENT DOCUMENTS

| | | | | | |
|---|---|---|---|---|---|
| 356,661 | A | | 1/1887 | Pfaff | |
| 500,274 | A | | 12/1894 | Wilkins | |
| 1,427,889 | A | | 9/1922 | Wittmann | |
| 1,676,197 | A | * | 7/1928 | Marrinan | 52/156 |
| 1,710,026 | A | * | 4/1929 | McCormick | 248/238 |
| 1,982,572 | A | * | 11/1934 | Colglazier et al. | 182/107 |
| 2,432,189 | A | * | 12/1947 | Bucher et al. | 182/214 |
| 2,700,242 | A | | 12/1949 | Porth | |
| 2,523,535 | A | | 9/1950 | Little | |
| 2,565,956 | A | * | 8/1951 | Duhamel | 43/44.4 |
| 2,574,286 | A | | 11/1951 | Rein | |
| 2,735,210 | A | * | 2/1956 | Hinkal | 43/43.6 |
| 2,940,204 | A | | 6/1957 | Mehnert | |
| 2,993,561 | A | | 7/1961 | Watson | |
| 3,284,945 | A | | 11/1966 | Kurtis | |
| 3,355,028 | A | * | 11/1967 | Mork | 211/21 |
| 3,534,751 | A | * | 10/1970 | Peters | 135/118 |
| 3,834,060 | A | * | 9/1974 | Wagenknecht | 43/44.8 |
| 4,007,807 | A | | 2/1977 | Pogwizd | |
| 4,545,460 | A | * | 10/1985 | Byrd | 182/107 |

(Continued)

OTHER PUBLICATIONS

Health and Safety Executive, The use of ladders and stepladders An employer's guide, HSE Books, Caerphilly Business Park, Caerphilly CF83 3GG, UK.

*Primary Examiner* — Katherine Mitchell
*Assistant Examiner* — Colleen M Chavchavadze
(74) *Attorney, Agent, or Firm* — Stephen C. Thomas

(57) ABSTRACT

A convenient ladder stabilization device for holding a ladder in place on a support surface. The device may attach to a lower rung of a ladder and extend and contact the support surface behind the ladder. The device of the present invention acts to secure and stabilize the bottom of the ladder to prevent the base of the ladder from sliding, skidding, or otherwise moving while a user is on the ladder. The present invention further provides for a lightweight and easy to use device that may be removably attached to any conventional ladder. The ladder stabilization device does not require any material alteration to the ladder and thus will not void the warranty of a conventional ladder when used in combination. The present invention improves user safety and reduces the need for having a second individual support the base of the ladder.

16 Claims, 6 Drawing Sheets

(56) References Cited

U.S. PATENT DOCUMENTS

| | | | | | |
|---|---|---|---|---|---|
| 4,576,250 | A | | 3/1986 | Marish | |
| 4,792,016 | A | * | 12/1988 | Ingalsbe et al. | 182/107 |
| 4,941,547 | A | | 7/1990 | Livick | |
| 5,067,588 | A | * | 11/1991 | Bendickson | 182/107 |
| 5,078,231 | A | * | 1/1992 | Davis | 182/107 |
| 5,337,856 | A | * | 8/1994 | Fillers | 182/107 |
| 5,400,516 | A | | 3/1995 | Kellenberger | |
| 5,664,643 | A | * | 9/1997 | Taylor, Jr. | 182/214 |
| 5,775,465 | A | * | 7/1998 | Vossler | 182/214 |
| 5,890,560 | A | | 4/1999 | Sloop | |
| 5,918,699 | A | * | 7/1999 | Summers | 182/107 |
| 6,032,402 | A | * | 3/2000 | Jilling et al. | 43/43.6 |
| 6,089,350 | A | | 7/2000 | Hankins | |
| 6,105,722 | A | * | 8/2000 | Taylor | 182/180.2 |
| 6,189,257 | B1 | | 2/2001 | Ulrich | |
| D440,275 | S | * | 4/2001 | Rosenberg | D22/144 |
| 6,219,956 | B1 | | 4/2001 | Hurt | |
| 6,588,603 | B1 | * | 7/2003 | West | 211/19 |
| 6,955,243 | B1 | | 10/2005 | Huff | |
| 7,367,425 | B2 | * | 5/2008 | Rivers et al. | 182/93 |
| 7,437,854 | B1 | | 10/2008 | O'Reilly | |
| 7,445,086 | B1 | | 11/2008 | Sizemore | |
| 7,469,497 | B2 | | 12/2008 | Hergott | |
| 7,743,886 | B2 | * | 6/2010 | Feemster et al. | 182/107 |
| 8,528,695 | B1 | * | 9/2013 | Orpia | 182/107 |
| 2006/0231333 | A1 | * | 10/2006 | Proulx | 182/107 |
| 2007/0289812 | A1 | | 12/2007 | Feemster et al. | |
| 2010/0051384 | A1 | | 3/2010 | Currie | |
| 2011/0100752 | A1 | * | 5/2011 | Donlon | 182/107 |

* cited by examiner

LADDER STABILIZATION DEVICE

CROSS REFERENCE TO RELATED APPLICATIONS

This application is a continuation-in-part and claims the benefit of utility patent application Ser. No. 12/620,636, filed with the USPTO on Nov. 18, 2009, now U.S. Pat. No. 8,464,834 which is herein incorporated by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention generally relates to ladder safety devices, more particularly, the present invention relates to a ladder stabilization device used for holding a ladder, such as a conventional extension ladder or straight ladder, in a stable condition on the support surface adjacent to a fixed structure. The present invention acts to resist both sliding and pivoting movements of the ladder and maintains the base of the ladder in a preset position relative to the fixed structure.

2. Background Art

Ladders come in various sizes and configurations for both indoor and outdoor use. By way of example, some typical ladders are configured as collapsible A-frame structures that tend to be self-supporting. Others ladders are configured for leaning against a fixed structure, such as an exterior wall of a building.

Carpenters, house painters, and other workmen whose trades require the use of such ladders are well aware of the hazards created when a ladder must be leaned against a wall or other similar surface for stability. Often, the angle at which a ladder must be erected is determined by limitations of available space or by the workman's need to stand near the top of the ladder rather than any considerations of stability or safety. In such situations, the ladder becomes less stable as the workman mounts higher on the rungs. In the course of using paint brushes, tools or other devices, a workman may shift his weight enough to cause the base of the ladder to break contact with the ground or slide along the ground, allowing the ladder to slip and fall. Serious injury often accompanies such accidents, not only from striking the ground, but from being struck by tools or materials as they fall from the ladder.

No universally satisfactory solution to ladder stability has been provided in the prior art. Ladders are used for many purposes on a wide variety of work surfaces, and any stabilizing means that is adequate for one set of conditions may often be unsuited for others. As an example, spikes driven into the ground at the base of the ladder are useful when working outdoors but would do considerable damage if used indoors on a hardwood floor. Such spikes also cannot be used when working on asphalt or concrete surfaces.

Regardless of the configuration, the stability of a ladder is an important consideration. In this regard, it is always recommended that in addition to the worker on the ladder, an additional worker be located at the base of the ladder in order to stabilize the ladder. Unfortunately, many workers operate independently and oftentimes scale and work atop ladders without having another worker support the ladder from below. The present invention obviates the need for an additional worker at the base of the ladder by providing a ladder stabilization device that may either remain mounted on or be quickly and easily attached to a lower rung of the ladder to be used. The invention effectively stabilizes the ladder during use by preventing twisting, pivoting, and shifting or sliding of the base of the ladder.

Past attempts at ladder stabilization have often involved apparatuses which, when installed, extended some distance in front of the ladder. Passersby, whose attention might be attracted by the workman at the top of the ladder, ran the risk of stumbling over such apparatus in front of the ladder which in turn, could cause the ladder to fall. Examples of such prior art include U.S. Pat. No. 2,523,535 to Little, describing an adjustable ladder anchor. The adjustable ladder anchor includes an extendable pole or tube attached to the base of a ladder. The ladder anchor includes a length of pipe and a stake for driving into a ground surface in front of the ladder base for holding the ladder in place. In U.S. Pat. No. 4,576,250 to Marish, a ladder stop with two projecting arm members and a pointed vertical member are disclosed. The two projecting arms cover one of the feet of the ladder base and the pointed vertical member is driven into the ground. In U.S. Pat. No. 4,941,547 to Livick, safety featured ladder scaffolding is illustrated comprising a flat rectangular plate and a safety stake. U-bolts attach the stake assembly to a rung of the ladder and the safety stake may be driven through a hole in the rectangular plate and into the ground in front of the ladder. In U.S. Pat. No. 7,445,086 to Sizemore, a ladder lock is disclosed having a telescoping pole and a base. The pole is attached to the bottom portion of the ladder and the base is secured against a wall or base board in front of the ladder.

Additional prior art may include U.S. Pat. No. 5,890,560 to Sloop describing a ladder stabilization device that attaches a rung of the ladder to the fixed structure upon which the ladder is leaning. In U.S. Pat. No. 6,089,350 to Hankins, a ladder safety anchor device is disclosed having a U-shaped wedge surface penetrating member that may limit the surfaces on which such a device may be used. Similarly, both U.S. Pat. No. 6,955,243 to Huff and U.S. Pat. Appl. No. 2007/0289812 to Feemster et al. comprise a pair of spike members that would limit and restrict the application of their respective devices to only more compliant support surfaces and terrains.

Many innovative devices focus on anchoring the bottom end of an inclined ladder to the surface directly at the base of the ladder, or a point in the surface opposite the object or fixed structure against which the ladder is placed. Many times there are situations where these devices cannot function as intended, such as where the base of the ladder rests on a relatively impervious surface, such as concrete, blacktop or paving stone. Thus, there remains an unmet need for a ladder anchor device that can maintain the base of an inclined ladder in a stable position on these as well as a variety of other surfaces.

It is an aspect of the present invention to provide a simple, easy to use ladder stabilization device that is universally adaptable to different terrains, surfaces, and working conditions.

A further aspect of the present invention is to design such a ladder stabilization device to be easily and inexpensively installed on or removed from any standard ladder without requiring special tools or skills.

A still further aspect of the present invention is to provide a lightweight and non-cumbersome ladder stabilization device that may be easily carried on a ladder or otherwise moved about a job site.

Yet further another aspect of the present invention may provide a ladder stabilization device comprising no moving parts and/or welded joints that eliminate potential points of failure or structural weaknesses as seen in device of the prior art.

A yet still further aspect of the present invention may provide a ladder stabilization device that may easily and quickly be added or removed from a conventional ladder without the user voiding the warranty of the ladder as is common with prior art devices requiring structural alterations to the ladder for device attachment and use.

None of the above mentioned prior art patents specifically disclose the unique features, structure, and function of the presently disclosed ladder stabilization device for holding the base of a ladder, or other securable object, in place.

BRIEF SUMMARY OF THE INVENTION

In accordance with one embodiment, a ladder stabilization device for holding a ladder in place on a support surface, the ladder stabilization device comprising at least one upper arm having a first end and a second end; at least one lower arm having a first end and a second end; and a first bend, wherein the first end of the at least one upper arm is connected to the first end of the at least one lower arm at the first bend.

In accordance with another embodiment of the present invention, a ladder stabilization device for holding a ladder in place on a support surface, the ladder stabilization device comprising a first loop; and a second loop, wherein the first loop is connected to the second loop at both a first junction and a second junction.

In accordance with another embodiment of the present invention, a ladder stabilization device for holding a ladder in place on a support surface, the ladder stabilization device comprising a first loop, comprising, a first upper arm having a first end and a second end, a first lower arm having a first end and a second end, and a first bend, wherein the first end of the first upper arm is connected to the first end of the first lower arm at the first bend; and a second loop, wherein the first loop is connected to the second loop at both a first junction and a second junction, the second loop comprising, a second upper arm having a first end and a second end, a second lower arm having a first end and a second end, and a second bend, wherein the first end of the second upper arm is connected to the first end of the second lower arm at the first bend; wherein the second end of the first upper arm connects with the second end of the second upper arm at the first junction, and the second end of the first lower arm connects with the second end of the second lower arm at the second junction; and wherein the first upper arm is parallel to the first lower arm, and the second upper arm is parallel to the second lower arm.

BRIEF DESCRIPTION OF THE DRAWINGS

A better understanding of the present invention will be realized from the detailed description that follows, taken in conjunction with the accompanying drawings, in which.

DETAILED DESCRIPTION OF THE INVENTION

Although the following detailed description contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention.

The present invention provides a lightweight and easy to use device that improves safety when an individual is using a ladder. One end of the device attaches to a lower rung of the ladder and the other end of the device is secured into the support surface behind the ladder. The present inventive device prevents the base of the ladder from slipping, skidding, or otherwise moving on the support surface while the ladder is in use. The present invention also eliminates the need of a having second individual stand on or otherwise support the base of the ladder while another user climbs upon and uses the ladder. The ladder stabilization device of the present invention may also remain secured to the ladder in a retracted position so that the device will remain attached to the ladder in a low profile state as needed and may then easily be redeployed whenever the ladder is used again. The present invention is lightweight and non-cumbersome allowing for an easy combination with conventional ladders. By being removably attachable to a lower rung of a ladder the device of the present invention does not require material alterations to the conventional ladder which may void the ladder's factory warranty as is required by many prior art devices.

Figure 1:
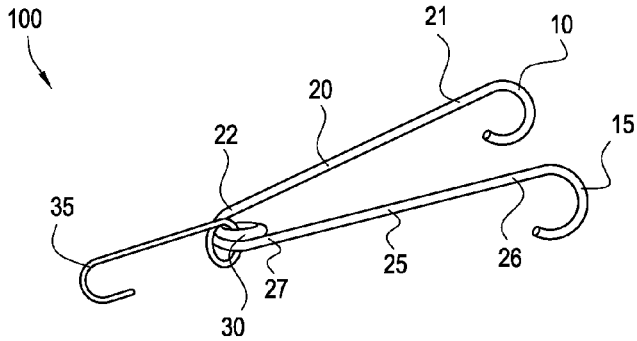
FIG. 1 depicts a perspective view of one embodiment of the ladder stabilization device of the present invention.
Figure 2:
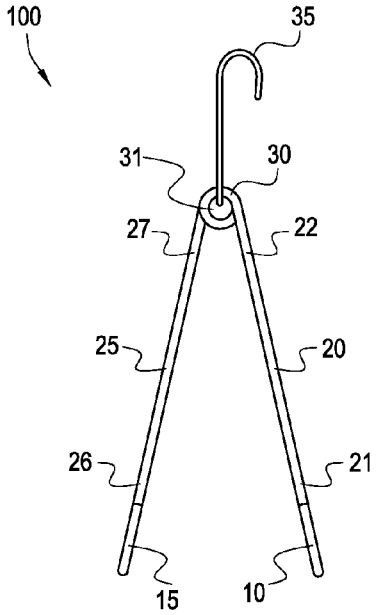
FIG. 2 depicts a top view of the embodiment of the ladder stabilization device of the present invention depicted in FIG. 1.
Figure 3:
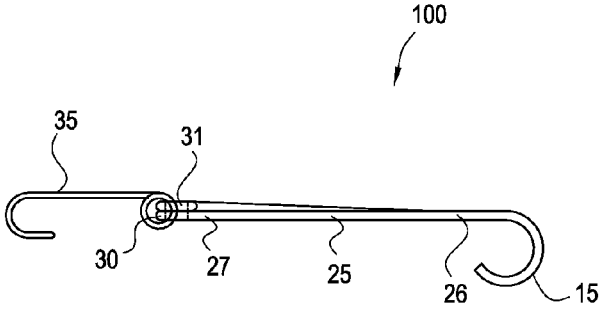
FIG. 3 depicts a side view of the embodiment of the ladder stabilization device of the present invention depicted in FIG. 1.

One embodiment of the ladder stabilization device 100 of the present invention is illustrated in FIGS. 1-3. The present invention may comprise a first retaining member 10 and a second retaining member 15 for securing the device 100 to a lower rung of a ladder (not shown). A first frame arm 20 having a first end 21 and a second end 22 may further comprise the first retaining member 10 coupled to the first end 21 of the first frame arm 20. A second frame arm 25 having a first end 26 and a second end 27 may have the second retaining member 15 coupled to the first end 26 of the second frame arm 15. An anchor element 30 is disposed at the junction of the second end 22 of the first frame arm 20 and the second end 27 of the second frame arm 25. The anchor element 30 of the present inventive device is used to provide a point of attachment between the ladder stabilization device 100 and a support surface. The anchor element 30 may define a central aperture 31 that may assist in securing the device 100 to a support surface. An optional storage fastener 35 may be attached to the anchor element 30 and be used to maintain the ladder stabilization device 100 in a retracted configuration when it is stored and not in use.

The ladder stabilization device 100 of the present invention may be composed of a variety of materials including but not limited to metal, plastic, wood, laminates, and the like, and any combinations thereof. In a preferred embodiment, the ladder stabilization device 100 may be composed from one unitary piece of material that may be bent, molded, or otherwise shaped to comprise the structural elements of the present invention. Such an embodiment comprising a unitary construction would eliminate moving parts, simplify the manufacturing process, and improve reliability of the device due to minimization of multiple points of potential failure found in other devices and systems within the prior art.

In a preferred embodiment, as shown in FIGS. 1-3, the first retaining member 10 and the second retaining member 15 may each respectively comprise a hook element that may encircle a lower rung on a ladder thereby providing both a first and second point of attachment with the ladder. Preferably, both the first retaining member 10 and the second retaining member 15 are attached to the lowest rung of the ladder. While hook elements are the preferred embodiments for the first and second retaining members 10,15, alternate embodiments may include straps having hook and loop fasteners, resilient C-shaped clamps, straps having a belt-like buckle member providing fixation, and the like that allow the first and second retaining members 10,15 to releasably retain or encircle the lower rung of a ladder. The first and second points of attachment may be rotatable about the lower rung of the ladder thereby allowing for pivotal movement of the ladder stabilization device 100 between a retracted configuration during storage and a deployed configuration during use.

As shown in FIGS. 1-3, a preferred embodiment of the anchor element 30 may comprise a coil configuration. The material extending from the second end 22 of the first frame arm 20 may be coiled or spooled one or more times about itself forming a central aperture 31 therein. The completed anchor element 30 may then be in communication with the second end 27 of the second frame arm 25. The anchor element 30 may alternately comprise structures including molded rings defining a central aperture 31, a bend in the shape of an acute angle in the material of the device 100 disposed at the junction of the first and second frame arms 20,25 without the presence or formation of a central aperture 31, and the like.

Figure 4:
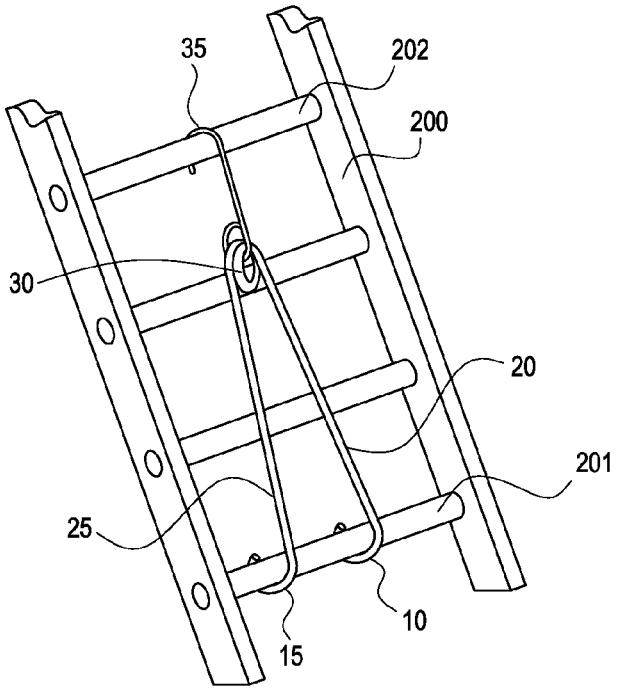
FIG. 4 depicts a perspective view of an embodiment of the ladder stabilization device of the present invention in the retracted configuration.
Figure 5:
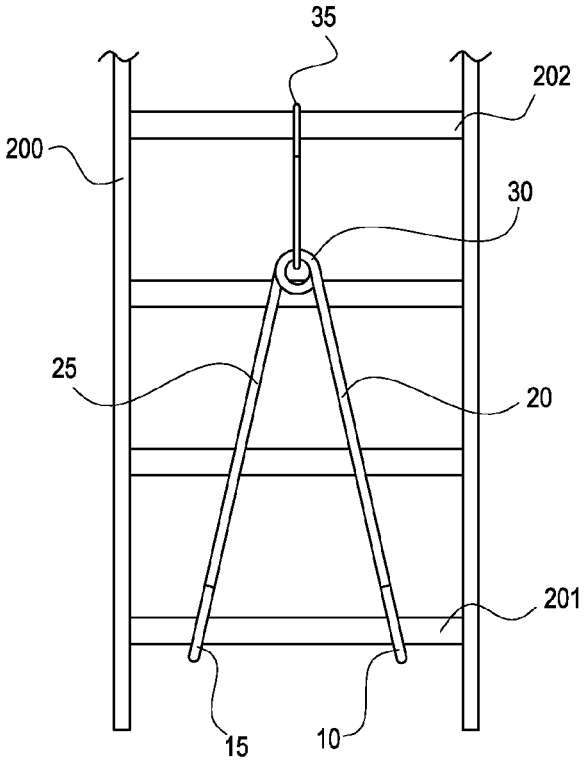
FIG. 5 depicts a rear view of an embodiment of the ladder stabilization device of the present invention in the retracted configuration

As shown in FIGS. 4-5, a storage fastener 35 may optionally be incorporated with the ladder stabilization device 100 of the present invention to assist in maintaining the device 100 in a retracted position allowing for easy storage or transport of a ladder 200 with the device 100 remaining attached to the ladder 200. In a preferred embodiment the storage fastener 35 may comprise a hook extending from the anchor element 30 in a direction opposite the first and second retaining members 10,15. The hook may be resilient in nature and of a sufficient length to reach and be fit about an upper rung 202 of the ladder 200 that is disposed above a lower rung 201 where the first and second retaining members 10,15 are rotatably attached. Similar to the first and second retaining members 10,15, the storage fastener 35 may comprise alternate embodiments including but not limited to a hook and loop fastener, a resilient C-shaped clamp, a strap providing for a belt buckle like fixation method, and the like. When the device 100 of the present invention is not in use it may be stored in a retracted position wherein the storage fastener 35 is in communication with an upper rung 202 of the ladder 200 thereby holding the device 100 against the rungs of the ladder 200 wherein the device 100 is disposed in a plane parallel to that of the ladder 200. When the ladder 200 is to be used, the storage element 35 may be removed from the upper rung 202 and the device 100 may then pivot about the lower rung 201 of the ladder 200 bringing the anchor element 30 into communication with the support surface 300 behind the ladder 200 (see FIG. 7).

Figure 6:
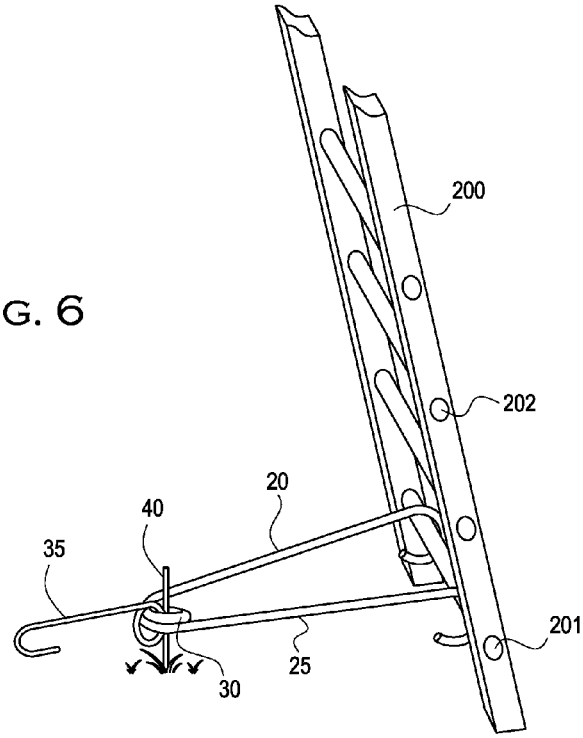
FIG. 6 depicts a perspective view of an embodiment of the ladder stabilization device of the present invention in the deployed configuration.
Figure 7:
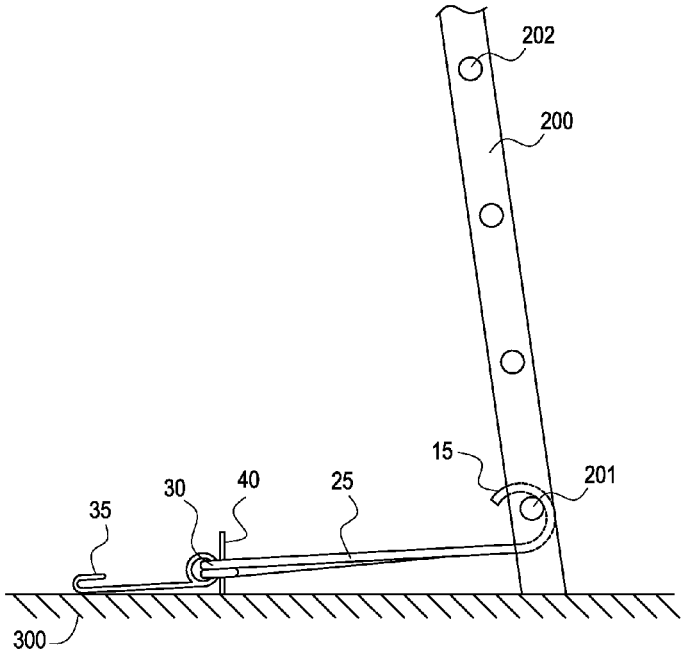
FIG. 7 depicts a side view of an embodiment of the ladder stabilization device of the present invention in the deployed configuration.
Figure 8:
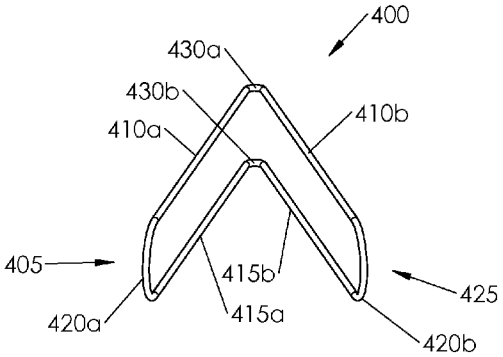
FIG. 8 depicts a front perspective view of another embodiment of a ladder stabilization device of the present invention.

Before climbing on a ladder 200 modified with the present invention, an individual may engage a piercing element 40 with the anchor element 30 of the device 100 after the device 100 has been disposed in a deployed configuration (see FIGS. 6-7). The piercing element 40 may be separate and independent from the device 100 of the present invention and be supplied by the user or the piercing element 40 may be an included component of the ladder stabilization device 100. In an alternate embodiment and to prevent loss of a loose or structurally independent piercing member 40, the present invention may include a piercing member 40 that is attached to the device 100 to prevent separation of the piercing element 40 from the device 100 and potential loss of the piercing member 40. The means of attachment may comprise a chain, cord, strap, or any other means known within the art allowing for the piercing element 40 be moved about the anchor element 30. The piercing element 40 may comprise a wide variety of articles or structures capable of engaging and securing the anchor element 30 to a support surface. Selection of a piercing element 40 may be dependent on the composition of the support surface 300 to be engaged and may include but are not limited to stakes such as tent stakes when the support surface comprises dirt or soil, wood screws when the support surface 300 comprises wood such as a porch or deck, concrete screws when the support surface 300 comprises concrete such as driveways or walkways, and the like. The piercing element 40 may pass through the central aperture 31 of the anchor element 30 and then penetrate or advance into the support surface 300 thereby securing the anchor element 30 of the ladder stabilization device 100 to the support surface 300. In embodiments having an anchor element 30 lacking a central aperture 31, the piercing element 40 may overlap or otherwise engage the anchor element 30. As an example, if the anchor element 30 comprises only a bend or acute angle formed in the material of the present inventive device 100, the piercing element 40 may penetrate the support surface 300 at the inside of the bend of the anchor element 40 and the penetration angle of the piercing element 40 may lean or angle away from the base of the ladder 200 so as to retain or fix the anchor element 30 in position when any sliding or skidding force is applied to the base of the ladder 200.

In use, the ladder stabilization device 100 of the present invention must first be incorporated onto a conventional ladder 200. The first and second retaining members 10,15 may be attached by encircling a lower rung 201 of a ladder 200. In a preferred embodiment, the first and second retaining members 10,15 comprise respective hook elements and encircle the lowest rung 201 on a conventional ladder 200. The first and second retaining member 10,15 provide a pivotal or rotatable connection point between the ladder stabilization device 100 and the lowest rung 201 of the ladder 200. As shown in FIGS. 4-5, the device 100 may then be pivoted to abut one or more adjacent rungs on the ladder 200 (depending on the overall length of the device 100) wherein the device 100 is then disposed in a plane that is parallel to the plane of the ladder 200. To assist in maintaining this retracted configuration of the device 100, a storage fastener 35 may provide a releasable connection with an upper rung 202 of the ladder 200. In a preferred embodiment, the storage fastener 35 comprises a resilient hook that may be bent about the upper rung 202 to maintain the device 100 in the retracted configuration during ladder 200 non-use, transport, storage, and the like.

When a ladder 200 modified with the present invention is used by an individual, the ladder stabilization device 100 may both improve safety and eliminate the need or desire for having a second person stand on or otherwise stabilize the base of the ladder 200. When the ladder 200 is positioned against the desired fixed structure such as a wall, a pole, a tree, or the like, the base of the ladder 200 may be secured by moving the ladder stabilization device 100 from a retracted configuration (FIGS. 4-5) to a deployed configuration (FIGS. 6-7). To initially move the present inventive device from its retracted position, the storage fastener 35 may be removed from its releasable connection with the upper rung 202 of the conventional ladder 200. The ladder stabilization device 100 may then be moved, rotated, or pivoted about the first and second points of attachment where the first and second retaining members 10,15 contact the lower rung 201 of the ladder 200. Such movement allows the anchor element 30 to come into communication with the support surface 300 in an area behind the conventional ladder. The piercing element 40 may then engage the anchor element 30 by passing through or about the anchor element 30. In one embodiment, the anchor element 30 may comprise a bend in the ladder stabilization device 100 of the present invention, while in a second preferred embodiment the anchor element 30 may comprise a structure that defines a central aperture 31 through which the piercing element 40 may pass. After the piercing element 40 passes through or otherwise engages the anchor element 30, the piercing element 40 may then be advanced and penetrate into the support surface 300 to secure the anchor element 30 to the support surface 300. In this manner, the ladder stabilization device 100 of the present invention secures the base of the conventional ladder 200 to the support surface 300 behind the ladder 200. Depending on the embodiment of the piercing element 40 selected, the upper portion of the piercing element 40 may be stepped on and/or tamped by a mallet, for example, to facilitate advancing or driving the piercing element 40 into the ground or other appropriate support surface 300. Other piercing element 40 embodiments, such as wood screws and concrete screws may require a tool such as a screwdriver to advance or drive the piercing element 40 into a much more resistant support surface 300 such as wood or concrete respectively.

The first and second points of attachment for the first and second retaining member 10,15 may comprise several embodiments. Embodiments incorporating loops, straps, hook and loop fasteners, and the like may not show any significant difference if the device 100 is "flipped over" or rotated 180 degrees about the central axis of the device 100 on the lower rung 201 of the ladder 200 due to the symmetry of the first and second points of attachment resulting from the encircling points of attachment. However, preferred embodiments such as those comprising hook elements may embody both an over hook configuration and an under hook configuration. As shown in FIG. 6, an over hook configuration may comprise the first and second retaining member 10,15 passing over the top surface of the lower rung 201 on the ladder 200. Similarly, as shown in FIG. 7, an under hook configuration may comprise the first and second retaining member 10,15 passing under or beneath the bottom surface of the lower rung 201 on the ladder 200. The scope of the present invention includes both the over hook and under hook configurations when the first and second retaining member 10,15 comprise hook elements. Selection of the most proper configuration may depend on a variety of variables including but not limited to the design and structures of the selected conventional ladder 200, the spacing of the rungs on the conventional ladder 200, and the like. For an embodiment of the present inventive device 100 to be stored on a ladder 200 when not in use, the means selected for providing the first and second attachment points may not interfere or prevent the ladder stabilization device 100 from moving between a deployed configuration and a retracted configuration.

Additionally, while preferred embodiments secure the anchor element 30 of the present invention to the support surface 300 behind the ladder 200 (as shown in FIGS. 6-7), the scope of the invention further includes alternate embodiments that secure the anchor element 30 of the present invention to the support surface 300 in front of the ladder 200. Such an alternate embodiment may be just as effective at preventing the skidding, sliding, or other movement of the base of a ladder 200, but such a configuration may create an additional tripping hazard for either the user or other individuals in the vicinity of the deployed ladder stabilization device 100 of the present invention.

FIGS. 8-11 depict another preferred embodiment of a ladder stabilization device 400 of the present invention. The device 400 may be fashioned from a unitary piece of construction or by the combination or two or more separate components. As shown best in FIGS. 10-11, a preferred embodiment of the device 400 may generally comprise a first loop 405 and a second loop 425. The first loop 405 may comprise a first upper arm 410*a* and a first lower arm 415*a*, wherein one end of the first upper arm 410*a* connects with one end of the first lower arm 415*a* at a first bend 420*a*. Likewise, the second loop 425 may comprise a second upper arm 410*b* and a second lower arm 415*b*, wherein one end of the second upper arm 410*b* connects with one end of the second lower arm 415*b* at a second bend 420*b*. Both the first bend 420*a* and the second bend 420*b* may be curvilinear, triangular, rectangular, any polygonal configuration, or any other shape capable of encompassing and/or encircling a rung of a conventional ladder.

Figure 9:
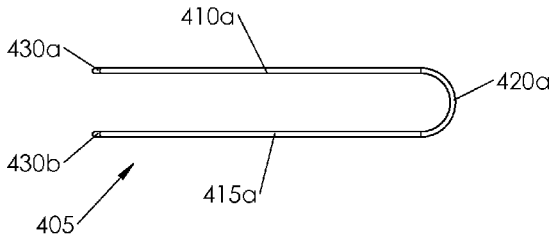
FIG. 9 depicts a side view of the embodiment of FIG. 8.
Figure 10:
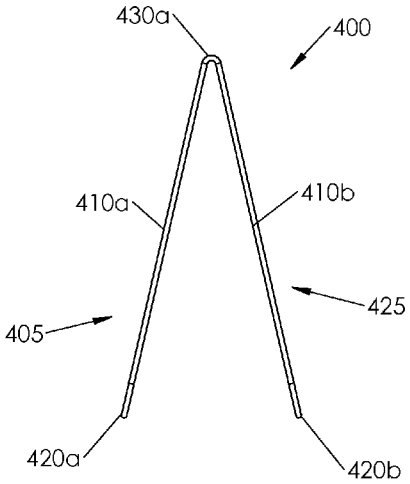
FIG. 10 depicts a top view of the embodiment of FIG. 8.
Figure 11:
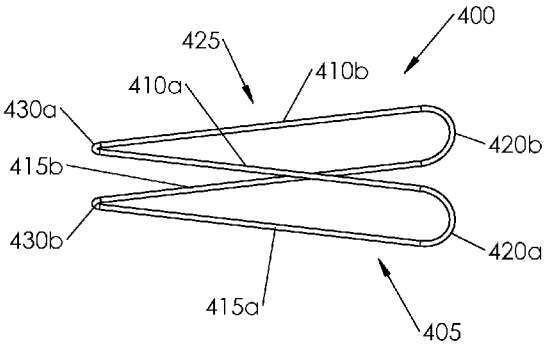
FIG. 11 depicts a side perspective view of the embodiment of FIG. 8.

In a preferred embodiment as best shown in FIG. 9, the first upper arm 410*a* and the first lower arm 415*a* may be parallel with each other and the second upper arm 410*b* and the second lower arm 415*b* may also be parallel with each other. However, such parallel configurations are not restrictive and the scope of the present invention also includes upper and lower arms of a non-parallel configuration. Opposite the first bend 420*a* and the second bend 420*b*, the first upper arm 410*a* of the first loop 405 may communicate with the second upper arm 410*b* of the second loop 425 at a first junction 430*a*. Similarly, opposite the first bend 420*a* and the second bend 420*b*, the first lower arm 415*a* of the first loop 405 may communicate with the second lower arm 415*b* of the second loop 425 at a second junction 430*b*. The first junction 430*a* and second junction 430*b* may comprise an angular bend, a ring, an aperture, and the like through or about which a piercing element 40 may pass to secure the device 400 to the support surface there under.

The piercing element 40 may comprise a wide variety of articles or structures capable of engaging and securing the first junction 430*a* and/or second junction 430*b* to a support surface or, alternatively, to a fixed structure preferably disposed either behind or under the ladder. Selection of a piercing element 40 may be dependent on the composition of the support surface to be engaged and may include but is not limited to a stake such as a tent stake or a U-shaped fastener when the support surface comprises dirt or soil, one or more wood screws when the support surface comprises wood such as a porch or deck, one or more concrete screws when the support surface comprises concrete such as driveways or walkways, and the like. The piercing element 40 may pass through or about the first junction 430*a* and/or second junction 430*b* and then penetrate or advance into the support surface thereby securing the ladder stabilization device 400 to the support surface. In embodiments having the first junction 430*a* and/or second junction 430*b* lacking a ring or other aperture, the piercing element 40 may overlap or otherwise engage the first junction 430 and/or second junction 435. As an example, if the first junction 430*a* and/or second junction 430*b* comprises only a bend or acute angle formed in the material of the present inventive device 400, the piercing element 40 may at least penetrate the support surface at the inside of the bend or angle and the penetration angle of the piercing element 40 may lean or angle away from the base of the ladder 200 so as to retain or fix the first junction 430*a* and/or second junction 430*b* in position when any sliding or skidding force is applied to the base of the ladder 200.

In one embodiment, the first junction 430*a* and/or second junction 430*b* may comprise a bend in the ladder stabilization device 400 of the present invention, while in a second preferred embodiment the first junction 430*a* and/or second junction 430*b* may comprise an anchor structure that defines a ring, an aperture, a hook, or the like through which the piercing element 40 may pass. After the piercing element 40 passes through or otherwise engages the first junction 430*a* and/or second junction 430*b*, the piercing element 40 may then be advanced and penetrate into the support surface to secure the device 400 to the support surface. In this manner, the ladder stabilization device 400 of the present invention may secure the base of the conventional ladder 200 to the support surface preferably behind, but alternatively in front of, the base of the ladder 200. Depending on the embodiment of the piercing element 40 selected, the upper portion of the piercing element 40 may be stepped on and/or tamped by a mallet, for example, to facilitate advancing or driving the piercing element 40 into the ground or other appropriate support surface. Other piercing element 40 embodiments, such as wood screws and concrete screws may require a tool such as a screwdriver or handheld powered drill to advance or drive the piercing element 40 into a more resistant support surface such as wood or concrete.

Figure 12:
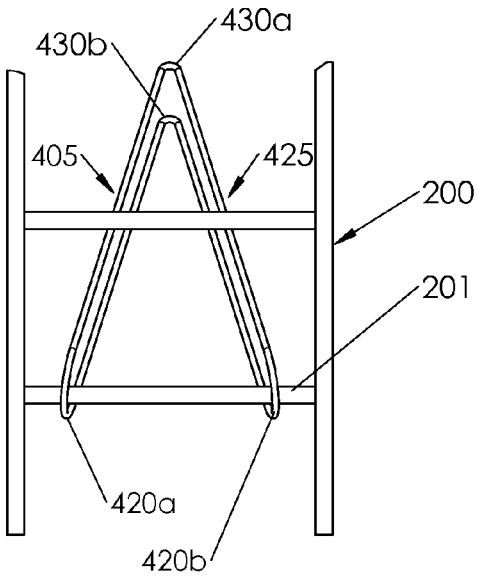
FIG. 12 depicts a front perspective view of the embodiment of FIG. 8 in use about a conventional ladder.
Figure 13:
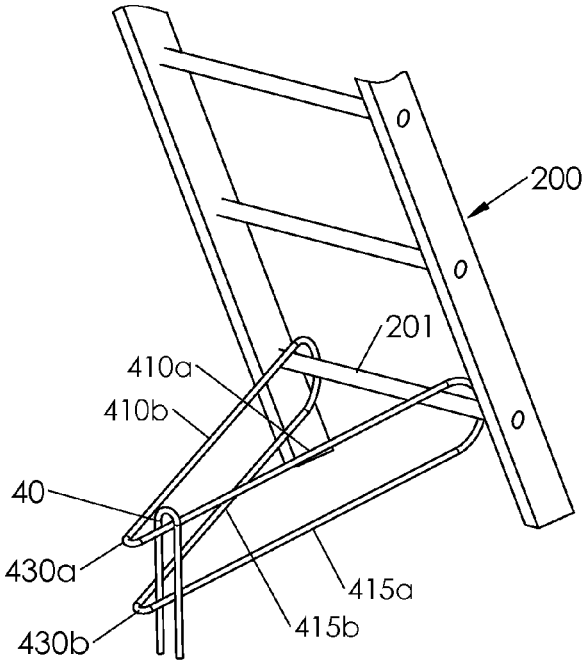
FIG. 13 depicts a rear perspective view of the embodiment of FIG. 8 in use about a conventional ladder.

FIGS. 12-13 depict the ladder stabilization device 400 in use and in communication with the lower rung 201 of a conventional ladder 200. The "open-ended" side of the device 400 disposed between the first junction 430*a* and second junction 430*b* and opposite the first bend 420*a* and second bend 420*b* may be slid over and about a ladder rung (preferably the lower rung 201 of a ladder 200). With a ladder 200 placed upon a support surface and leaning against a wall or other applicable structure, the device 400 may be slid onto a rung of the ladder 200 such that the rung comes into contact with both the first bend 420*a* and the second bend 420*b* as shown in FIGS. 12-13. With the bends 420*a*/420*b* of the device 400 abutting against a ladder rung, the first junction 430*a* and/or second junction 430*b* may be secured to the support surface by one or more piercing devices 40 as disclosed and described above. FIG. 13 depicts a single piercing element 40 passing about both the first junction 430*a* and second junction 430*b*, wherein such a piercing element 40 (e.g. a U-shaped fastener or stake) may be best suited for soil, dirt, grass, or other generally "soft" support surfaces. Alternatively, a piercing element 40 may only pass through or about one of the two junctions 430*a*/430*b* when securing the device 400 to the support surface. In still another embodiment, a first piercing element may be used to secure the first junction 430*a* to the support surface and a second piercing element may be used to secure the second junction 430*b* to the support surface.

Figure 14:
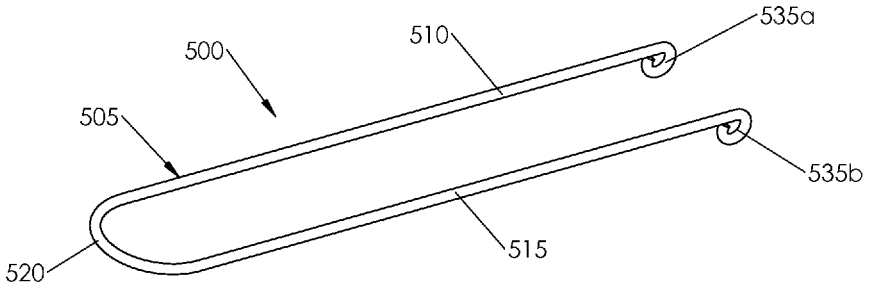
FIG. 14 depicts a perspective view of still another embodiment of a ladder stabilization device of the present invention.

An alternate version of the ladder stabilization device 500 of the present invention, as shown in FIG. 14, may comprise a single loop 505 having an upper arm 510 and a lower arm 515, wherein one end of the upper arm 510 connects with one end of the lower arm 515 at bend 520. At least one anchor element 30 may be disposed on the end of the upper arm 510 and/or the lower arm 515 opposite the bend 520. FIG. 14 depicts a preferred embodiment having an anchor element 30 at the end of both the upper arm 510 and the lower arm 515, while the scope of the present invention further includes one anchor element 30 at the end of only the upper arm 510 or the lower arm 515.

Figure 15:
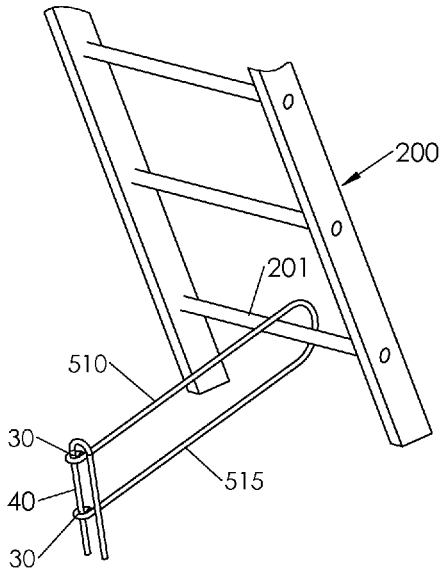
FIG. 15 depicts a rear perspective view of the embodiment of FIG. 14 in use about a conventional ladder.

The ladder stabilization device 500 may be placed about the rung of a ladder as depicted in FIG. 15, wherein only the single loop 505 encircles the ladder rung and a piercing element 40 may secure one or more anchor elements 30 to the support surface. The use of two anchor elements 30 (as depicted) may provide for resistance to a greater force applied to the base of a ladder, prevent the ladder base from pivoting as may happen when using only a single loop 505, and use of two anchor elements 30 may further prevent the single loop 505 from "flexing" or "bending" open if a substantial force is placed upon the ladder and thereby the bend 520 having only one arm 510/515 secured.

As will be appreciated from the design, the ladder stabilizing devices of the present invention maintain the base of the ladder in place at the same distance from the wall or other structure against which it is deployed. This ensures that the base of the ladder will not slip or slide away from its initial chosen position and a worker can safely ascend the ladder, knowing it will remain stable.

It should be emphasized that many variations and modifications may be made to the above-described embodiments. By way of example, although the embodiments described herein incorporate the use of straight ladders, various other types of ladders, such as A-frame ladders could be used. All such modifications and variations are intended to be included herein within the scope of this disclosure and protected by the following claims and their legal equivalents, and not by the specific examples given.

What is claimed is:

1. A ladder stabilization device for holding a ladder in place on a support surface, said ladder stabilization device comprising:

a first loop; and a second loop, wherein said first loop is connected to said second loop at both a first junction and a second junction;

wherein said first junction comprises a first angular bend and said second junction comprises a second angular bend, said first angular bend and said second angular bend each forming a non-straight angle between said first loop and said second loop, said non-straight angle having a vertex at said first angular bend and said second angular bend such that said first loop and said second loop of said device form a V-shape configuration;

wherein said first loop further comprises:

a first upper arm having a first end and a second end;

a first lower arm having a first end and a second end; and a first bend, wherein said first end of said first upper arm is connected to said first end of said first lower arm at said first bend; and wherein said second loop further comprises:

a second upper arm having a first end and a second end;

a second lower arm having a first end and a second end; and a second bend, wherein said first end of said second upper arm is connected to said first end of said second lower arm at said second bend;

wherein said second end of said first upper arm connects with said second end of said second upper arm at said first junction, and said second end of said first lower arm connects with said second end of said second lower arm at said second junction.

2. The ladder stabilization device of claim 1, wherein said first upper arm is parallel to said first lower arm, and said second upper arm is parallel to said second lower arm.

3. The ladder stabilization device of claim 1, wherein said first junction further comprises at least one upper anchor element.

4. The ladder stabilization device of claim 3, wherein said at least one upper anchor element is independently selected from the group consisting of a bend, a hook, and a ring.

5. The ladder stabilization device of claim 3, further comprising:

at least one piercing member capable of communicating with said at least one upper anchor element for securing said device to said support surface.

6. The ladder stabilization device of claim 5, wherein said at least one piercing member comprises a U-shaped anchor.

7. The ladder stabilization device of claim 1, wherein said device is capable of having a rung of said ladder passed between said first junction and said second junction, whereafter said rung is capable of passing between said first upper arm and said first lower arm of said first loop and said rung is also capable of passing between said second upper arm and said second lower arm of said second loop.

8. The ladder stabilization device of claim 1, wherein said second junction further comprises at least one lower anchor element.

9. The ladder stabilization device of claim 8, wherein said at least one lower anchor element is independently selected from the group consisting of a bend, a hook, and a ring.

10. The ladder stabilization device of claim 8, further comprising:

at least one piercing member capable of communicating with said at least one lower anchor element for securing said device to said support surface.

11. The ladder stabilization device of claim 10, wherein said at least one piercing member comprises a U-shaped anchor.

12. A ladder stabilization device for holding a ladder in place on a support surface, said ladder stabilization device comprising:

a first loop, comprising;

a first upper arm having a first end and a second end;

a first lower arm having a first end and a second end; and a first bend, wherein said first end of said first upper arm is connected to said first end of said first lower arm at said first bend; and a second loop, wherein said first loop is connected to said second loop at both a first junction and a second junction, said second loop comprising:

a second upper arm having a first end and a second end;

a second lower arm having a first end and a second end; and a second bend, wherein said first end of said second upper arm is connected to said first end of said second lower arm at said first bend;

wherein said second end of said first upper arm connects with said second end of said second upper arm at said first junction, and said second end of said first lower arm connects with said second end of said second lower arm at said second junction; and wherein said first upper arm is parallel to said first lower arm, and said second upper arm is parallel to said second lower arm; and wherein said first junction comprises a first angular bend and said second junction comprises a second angular bend, said first angular bend and said second angular bend forming a non-straight angle between said first loop and said second loop, said non-straight angle having a vertex at said first angular bend and said second angular bend such that said first loop and said second loop of said device form a V-shape configuration.

13. The ladder stabilization device of claim 12, wherein said device is capable of having a rung of said ladder passed between said first junction and said second junction, whereafter said rung is capable of passing between said first upper arm and said first lower arm of said first loop and said rung is also capable of passing between said second upper arm and said second lower arm of said second loop.

14. The ladder stabilization device of claim 12, further comprising:

at least one piercing member capable of communicating with said first junction for securing said device to said support surface.

15. The ladder stabilization device of claim 12, further comprising:

at least one piercing member capable of communicating with said second junction for securing said device to said support surface.

16. The ladder stabilization device of claim 12, further comprising:

at least one piercing member capable of communicating with said first junction and said second junction for securing said device to said support surface.

* * * * *